US009982623B2

(12) United States Patent
Kim et al.

(10) Patent No.: US 9,982,623 B2
(45) Date of Patent: May 29, 2018

(54) APPARATUS AND METHOD FOR PREVENTING OVERFLOW OF FUEL FROM VEHICLE FUEL TANK

(71) Applicant: Hyundai Motor Company, Seoul (KR)

(72) Inventors: Keun Soo Kim, Yongin-Si (KR); June Young Park, Hwaseong-si (KR); Chang Jun Park, Changwon-si (KR); Seung Kyun Lee, Gwacheon-si (KR); Chang Han Park, Gwangju (KR)

(73) Assignee: Hyundai Motor Company, Seoul (KR)

( * ) Notice: Subject to any disclaimer, the term of this patent is extended or adjusted under 35 U.S.C. 154(b) by 0 days. days.

(21) Appl. No.: 15/374,824

(22) Filed: Dec. 9, 2016

(65) Prior Publication Data

US 2018/0017009 A1 Jan. 18, 2018

(30) Foreign Application Priority Data

Jul. 12, 2016 (KR) ..... 10-2016-0087804

(51) Int. Cl.

| | |
|---|---|
| ***F02D 41/00*** | (2006.01) |
| ***F02D 41/30*** | (2006.01) |
| ***F02D 41/04*** | (2006.01) |
| ***F02M 59/34*** | (2006.01) |

(52) U.S. Cl.

CPC ..... *F02D 41/3082* (2013.01); *F02D 41/042* (2013.01); *F02M 59/34* (2013.01)

(58) Field of Classification Search

CPC ..... F02D 41/3082; F02M 25/0836; F02M 25/089

USPC ..... 123/516–520, 497

See application file for complete search history.

(56) References Cited

U.S. PATENT DOCUMENTS

| | | | | |
|---|---|---|---|---|
| 4,469,075 | A * | 9/1984 | Jackson | F02M 17/20 123/523 |
| 4,565,170 | A * | 1/1986 | Grieshaber | F02D 41/042 123/198 DB |
| 5,845,623 | A * | 12/1998 | Blizard | F02M 55/00 123/198 DB |
| 6,453,877 | B1 * | 9/2002 | Lucier | F02M 37/20 123/457 |
| 8,312,863 | B2 * | 11/2012 | Ibrahim | F01N 9/00 123/446 |
| 9,840,990 | B2 * | 12/2017 | Nonaka | F02M 37/0052 |
| 2002/0162457 | A1 * | 11/2002 | Hyodo | F02M 25/089 96/109 |

(Continued)

FOREIGN PATENT DOCUMENTS

| | | |
|---|---|---|
| JP | 1996-244477 | 9/1996 |
| JP | 2001-032752 A | 2/2001 |
| JP | 2010-163909 A | 7/2010 |

(Continued)

*Primary Examiner* — Thomas Moulis

(74) *Attorney, Agent, or Firm* — Morgan, Lewis & Bockius LLP

(57) ABSTRACT

An apparatus and a method for preventing overflow of fuel from a vehicle fuel tank are provided may prevent liquid fuel from overflowing into a canister by for a predetermined time storing liquid fuel, which overflows from a fuel tank through a vent valve while the vehicle is traveling, in a fuel overflow prevention chamber, and by returning the fuel in the fuel overflow prevention chamber to the fuel tank by driving a fuel pump in a reverse direction when an engine is turned off.

9 Claims, 4 Drawing Sheets

(56) References Cited

U.S. PATENT DOCUMENTS

| | | | | |
|---|---|---|---|---|
| 2015/0184620 | A1 | 7/2015 | Dudar et al. | |
| 2017/0114744 | A1* | 4/2017 | Martin | F02M 25/0818 |

FOREIGN PATENT DOCUMENTS

| | | | |
|---|---|---|---|
| KR | 10-2004-0043762 | A | 5/2004 |
| KR | 10-2004-0103250 | | 12/2004 |
| KR | 10-2005-0002556 | | 1/2005 |
| KR | 10-2007-0027923 | | 3/2007 |
| KR | 10-2009-0109930 | | 10/2009 |

* cited by examiner

APPARATUS AND METHOD FOR PREVENTING OVERFLOW OF FUEL FROM VEHICLE FUEL TANK

CROSS-REFERENCE TO RELATED APPLICATION

The present application claims priority to Korean Patent Application No. 10-2016-0087804 filed on Jul. 12, 2016, the entire contents of which is incorporated herein for all purposes by this reference.

BACKGROUND

Field of the Invention

The present invention relates to an apparatus and method for preventing overflow of fuel from a vehicle fuel tank. More particularly, it relates to an apparatus and method for preventing overflow of fuel from a vehicle fuel tank, configured for preventing liquid fuel from overflowing into a canister from a fuel tank.

Description of Related Art

In general, a vehicle fuel system includes a canister to prevent fuel evaporation gas generated in a fuel tank from leaking to an outside. The canister collects fuel evaporation gas generated in the fuel tank to supply the fuel evaporation gas to an engine.

The fuel tank is equipped with a vent valve for discharging the fuel evaporation gas that is generated in the fuel tank to the canister. The vent valve serves to prevent liquid fuel from flowing into the canister when fuel leakage is a concern when the vehicle is parked in a sloped region or overturns.

However, when the sealing performance of the vent valve is insufficient or an abnormality thereof occurs while the vehicle is traveling, liquid fuel overflowing from the fuel tank through the vent valve may be introduced into the canister.

When liquid fuel is introduced into the canister, a stalling phenomenon may occur due to the introduction of the liquid fuel into the engine from the canister. Moreover, the activated carbon in the canister may be wetted by the liquid fuel, and for this reason fuel evaporation gas is not collected in the canister but is discharged to the atmosphere.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an apparatus and method for preventing overflow of fuel from a vehicle fuel tank, which is configured for preventing liquid fuel from overflowing into a canister by temporarily storing liquid fuel, which overflows from a fuel tank through a vent valve while a vehicle is traveling, in a fuel overflow prevention chamber, and by returning the fuel in the fuel overflow prevention chamber to the fuel tank by driving a fuel pump in a reverse direction when an engine is turned off.

In an exemplary embodiment, an apparatus for preventing overflow of fuel from a vehicle fuel tank includes a fuel overflow prevention chamber configured to store liquid fuel leaking through a vent valve mounted to a fuel tank while a vehicle travels, and a fuel pump driven in a reverse direction for a predetermined time when an engine is turned off, to collect the liquid fuel stored in the fuel overflow prevention chamber.

The vent valve may be connected with a vent line through which fuel evaporation gas generated in the fuel tank flows to canister, and the fuel overflow prevention chamber may be connected to a central portion of the vent line to fluidically-communicate therewith.

A return line may be provided between the fuel overflow prevention chamber and the fuel pump to return the fuel from the fuel overflow prevention chamber to the fuel tank when the fuel pump is driven in the reverse direction. A reverse check valve may be mounted in the return line to prevent the fuel in the fuel tank from flowing into the fuel overflow prevention chamber when the fuel pump is driven in a forward direction.

A forward check valve may be mounted in a discharge port of the fuel pump to prevent a fuel remaining in a feed line, provided between the fuel pump and the engine, from flowing into the fuel tank when the fuel pump is driven in the reverse direction.

In another exemplary embodiment, a method of preventing overflow of fuel from a vehicle fuel tank includes storing liquid fuel, discharged through a vent valve of a fuel tank while a vehicle travels, in a fuel overflow prevention chamber, and returning the fuel in the fuel overflow prevention chamber to the fuel tank by driving a fuel pump in a reverse direction for a predetermined time when the engine is stopped.

The storing of liquid fuel may include separating the liquid fuel from fuel evaporation gas in a vent line connected between the vent valve and a canister, and preventing the fuel in the fuel tank from flowing into the fuel overflow prevention chamber, when the fuel pump is driven in a forward direction, by closing a return line between the fuel overflow prevention chamber and the fuel pump using a reverse check valve mounted in the return line.

The returning of the fuel in the fuel overflow prevention chamber to the fuel tank may include preventing a fuel remaining in a feed line, provided between the fuel pump and the engine, from flowing into the fuel tank, when the fuel pump is driven in the reverse direction, by closing a discharge port of the fuel tank using a forward check valve mounted in the discharge port.

Other aspects and exemplary embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
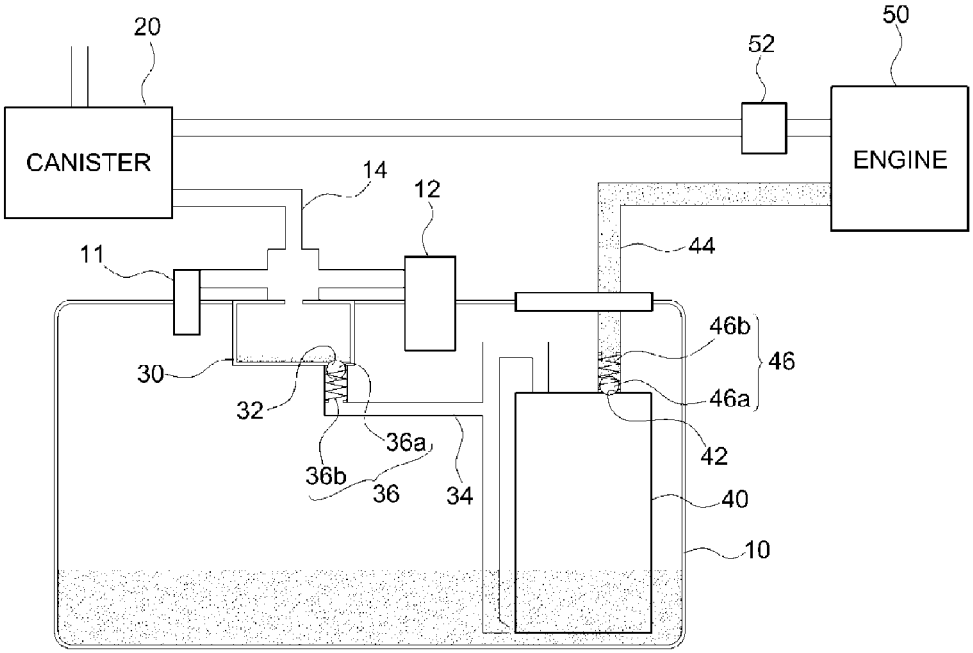
FIG. 1 is a view illustrating a state in which liquid fuel overflowing from a fuel tank while a vehicle is traveling is stored in a fuel overflow prevention chamber according to an exemplary embodiment of the present invention.

It should be understood that the appended drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Figure 2:
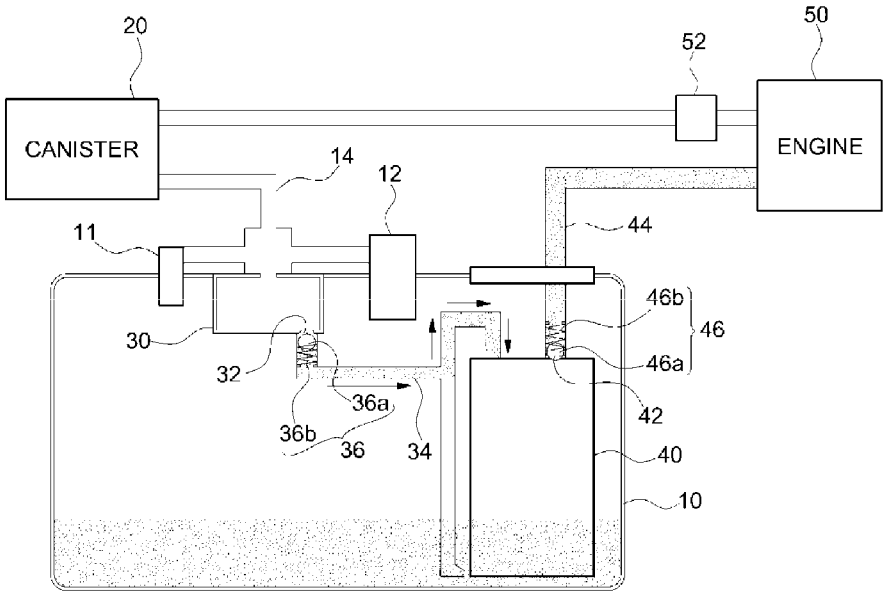
FIG. 2 is a view illustrating a state in which the fuel in the fuel overflow prevention chamber is returned to the fuel tank through the reverse driving of a fuel pump when an engine is turned off according to the exemplary embodiment of the present invention.
Figure 3:
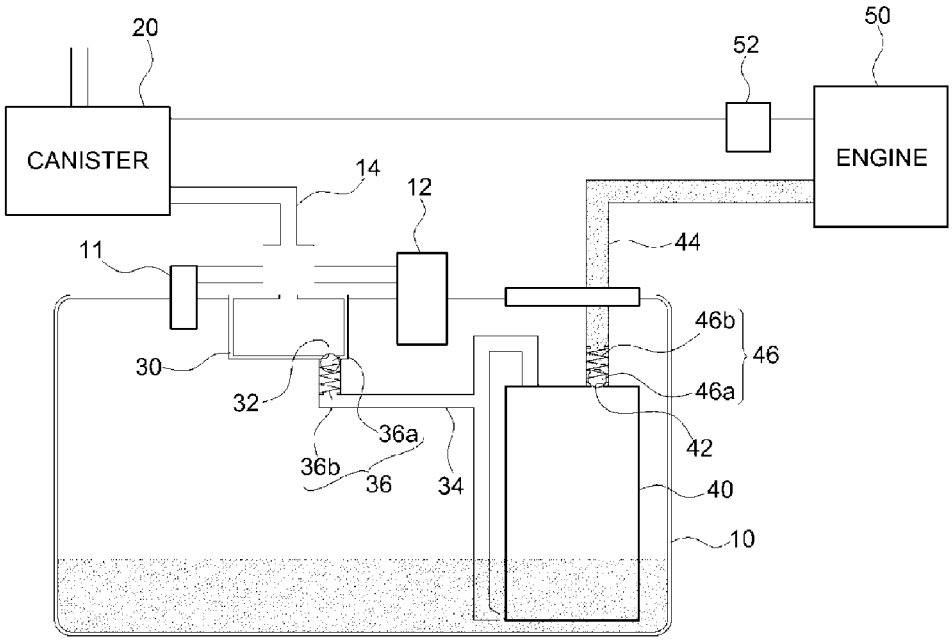
FIG. 3 is a view illustrating a state in which all of the fuel in the fuel overflow prevention chamber is returned to the fuel tank after a predetermined time has elapsed after the engine is turned off according to the exemplary embodiment of the present invention.

As illustrated in FIGS. 1 to 3, a vent valve 11 and/or 12 is mounted to the upper end of a fuel tank 10 for storing fuel for a vehicle, in order to discharge fuel evaporation gas, which is generated in the fuel tank 10, to a canister 20.

The fuel tank 10 includes at least one vent valve 11 or 12. A vent line 14 is connected between the vent valve 11 and/or 12 and the canister 20 to transfer the fuel evaporation gas from the vent valve 11 and/or 12 to the canister 20.

The vent valve 11 and/or 12 serves to prevent the flow of liquid fuel to an outside the fuel tank 10 and to prevent the liquid fuel from flowing into the canister 20, when fuel leakage is a concern when the vehicle is parked in a sloped region or overturns.

However, when the sealing performance of the vent valve 11 and/or 12 is insufficient or an abnormality thereof occurs, liquid fuel may leak into the vent line 14 through the vent valve 11 and/or 12 while the vehicle is traveling.

Accordingly, a fuel overflow prevention chamber 30, in which the liquid fuel discharged through the vent valve 11 and/or 12 is separated from the fuel evaporation gas and is stored, is connected to the central portion of the vent line 14.

That is, the liquid fuel discharged through the vent valve 11 and/or 12 is separated from the gas-phase fuel evaporation gas due to gravity and a difference in weight in the vent line 14, and is for a predetermined time stored in the fuel overflow prevention chamber 30 (see FIG. 1).

The fuel overflow prevention chamber 30 is positioned at an upper side in the fuel tank 10, and fluidically-communicates with the vent line 14 to collect the liquid fuel, which is separated from the fuel evaporation gas and is dropped in the vent line 14.

That is, the fuel overflow prevention chamber 30 is positioned under the central portion (i.e. the communication portion) of the vent line 14 to fluidically-communicate with the vent line 14. Accordingly, the liquid fuel, which is discharged from the fuel tank 10 through the vent valve 11 and/or 12 while the vehicle is traveling, is separated from the gas-phase fuel evaporation gas in the vent line 14, and is then introduced to and stored in the fuel overflow prevention chamber 30.

To return the liquid fuel stored in the fuel overflow prevention chamber 30 to the fuel tank 10, a fuel pump 40 is driven in a reverse direction when an engine 50 is configured to be stopped (turned off) (see FIG. 2).

As is well known in the art, the fuel pump 40 is mounted in the fuel tank 10 and serves to pump fuel and transfer it to the engine 50 by a forward-direction driving. The fuel pump 40 is not driven when the engine 50 is stopped.

Here, the liquid fuel stored in the fuel overflow prevention chamber 30 may be returned to the fuel tank 10 by reversely driving the fuel pump 40 for a predetermined time when the engine 50 is stopped.

In the instant case, a return line 34 is connected between the fuel overflow prevention chamber 30 and the fuel pump 40 to return the fuel from the fuel overflow prevention chamber 30 to the fuel tank 10. The liquid fuel stored in the fuel overflow prevention chamber 30 is returned to the fuel tank 10 by applying a suction force to the return line 34 through the reverse driving of the fuel pump 40.

A reverse check valve 36 is mounted in the return line 34 to prevent the fuel in the fuel tank 10 from flowing into the fuel overflow prevention chamber 30 when the fuel pump 40 is driven in a forward direction while the engine 50 is being driven.

In more detail, the reverse check valve 36 opens the return line 34 when the fuel pump 40 is driven in the reverse direction, so that the fuel in the fuel overflow prevention chamber 30 may be returned to the fuel tank 10. The reverse check valve 36 closes the return line 34 when the fuel pump 40 is driven in the forward direction, preventing the fuel in the fuel tank 10 from flowing to the fuel overflow prevention chamber 30.

In the instant case, to prevent the fuel remaining in the return line 34 from flowing to the fuel overflow prevention chamber 30, the reverse check valve 36 is preferably mounted between the fuel overflow prevention chamber 30 and the return line 34 (i.e. in an outlet port 32 of the fuel overflow prevention chamber 30), or on the upstream side of the return line 34 (on the basis of the flow direction of the liquid fuel discharged from the fuel overflow prevention chamber 30).

For example, the reverse check valve 36 may include a valve body **36*a* which may airtightly open and close the outlet port 32 of the fuel overflow prevention chamber 30, and an elastic member 36***b* which is mounted in the return line to elastically support the valve body 36*a* toward the outlet port 32.

Meanwhile, a feed line 44 is connected between the fuel pump 40 and the engine 50 to transfer fuel from the fuel tank 10 to the engine 50 when the fuel pump 40 is driven in the forward direction.

Here, to prevent the fuel remaining in the feed line 44 from flowing to the fuel tank 10 when the fuel pump 40 is reversely driven when the engine is turned off, a forward check valve 46 is mounted in a discharge port 42 of the fuel pump 40, through which the fuel transferred to the engine 50 is discharged, or is mounted on the upstream side of the feed line 44 (on the basis of the flow direction of the liquid fuel discharged from the fuel pump 40).

In more detail, the forward check valve 46 opens the discharge port 42 of the fuel pump 40 and the feed line 44 when the fuel pump 40 is driven in the forward direction, so that the fuel in the fuel tank 10 is supplied to the engine 50. The forward check valve 46 closes the discharge port 42 of the fuel pump 40 and the feed line 44 when the fuel pump 40 is driven in the reverse direction, preventing the fuel remaining in the feed line 44 from flowing to the fuel tank 10.

The forward check valve 46 may have a same structure as the reverse check valve 36. That is, the forward check valve 46 may include a valve body 46*a* which may airtightly open and close the discharge port 42 of the fuel pump 40, and an elastic member 46*b* which is mounted in the feed line 44 to elastically support the valve body 46*a* toward the discharge port 42.

Although not shown in the drawings, the forward and reverse driving of the fuel pump 40 is configured to be controlled by a control module.

In addition, the apparatus for preventing the overflow of fuel from a vehicle fuel tank is applicable to all of a typical gasoline vehicle, a plug-in hybrid electric vehicle (PHEV), etc.

For reference, reference numeral 52 is a purge control solenoid valve (PCSV) for providing the fuel evaporation gas collected in the canister 20 to the engine.

Figure 4:
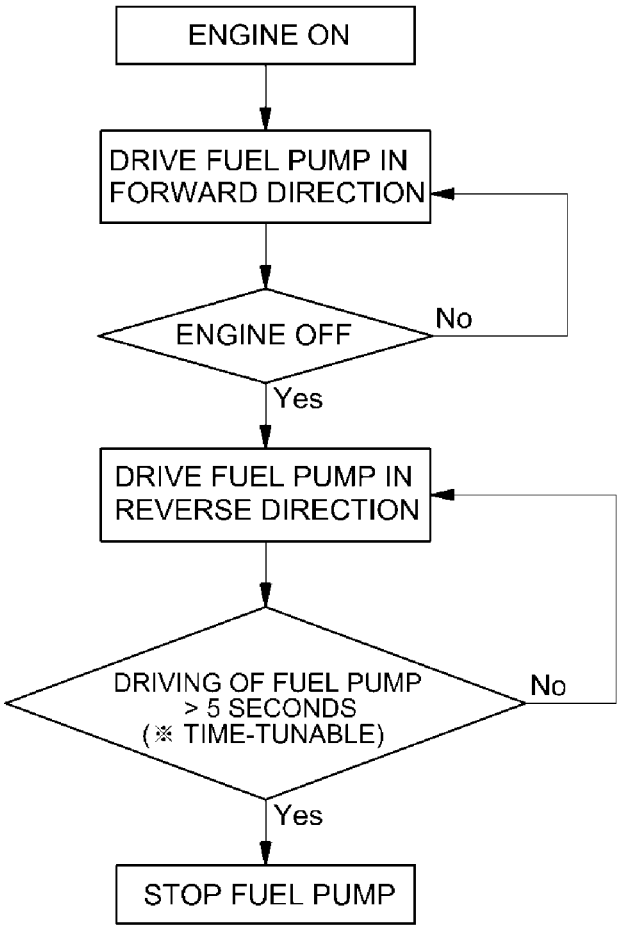
FIG. 4 is a flowchart illustrating a method of controlling the fuel pump for the collection of the fuel in the fuel overflow prevention chamber according to the exemplary embodiment of the present invention.

Hereinafter, a method of controlling the driving of the fuel pump 40 according to the exemplary embodiment of the present invention will be described in more detail with reference to FIG. 4.

First, the driving state of the engine 50 is determined. When it is determined that the engine 50 is being driven, the fuel pump 40 is driven in the forward direction such that the fuel in the fuel tank 10 may be transferred to the engine.

When the liquid fuel in the fuel tank 10 is discharged through the vent valve 11 and/or 12 due to the tilting of the vehicle at a predetermined angle or more while the fuel pump 40 is driven in the forward direction, the liquid fuel, which leaks to the vent line 14 through the vent valve 11 and/or 12, is collected into the fuel overflow prevention chamber 30 (see FIG. 1).

Next, when the engine 50 is stopped, the fuel pump 40 is driven in the reverse direction for a predetermined time in order to discharge the liquid fuel, which is stored in the fuel overflow prevention chamber 30, to the fuel tank 10 (see FIG. 2). When the collection of the fuel in the fuel overflow prevention chamber 30 is completed after the fuel pump 40 is driven in the reverse direction for a predetermined time, the fuel pump 40 is stopped (see FIG. 3).

Here, the predetermined time may be set to be an appropriate time for collecting the liquid fuel in the fuel overflow prevention chamber 30, determined through previous tests and evaluation.

As is apparent from the above description, the present invention can prevent liquid fuel from overflowing into a canister from a fuel tank while a vehicle is traveling, and thus can prevent a stalling phenomenon incurred due to the introduction of the liquid fuel into an engine from the canister. In addition, the present invention can prevent the canister from malfunctioning due to the wetting of the activated carbon in the canister by the liquid fuel, and thus can prevent fuel evaporation gas from being discharged to the atmosphere.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus for preventing overflow of fuel from a fuel tank, comprising:

a fuel overflow prevention chamber configured to store liquid fuel leaking through a vent valve mounted to the fuel tank while a vehicle travels; and a fuel pump driven in a reverse direction for a predetermined time when an engine is turned off, to collect the liquid fuel stored in the fuel overflow prevention chamber.

2. The apparatus of claim 1, wherein the vent valve is connected with a vent line through which fuel evaporation gas generated in the fuel tank flows to a canister, and the fuel overflow prevention chamber is connected to a central portion of the vent line to fluidically-communicate therewith.

3. The apparatus of claim 1, wherein a return line is mounted between the fuel overflow prevention chamber and the fuel pump to return the fuel from the fuel overflow prevention chamber to the fuel tank when the fuel pump is driven in the reverse direction.

4. The apparatus of claim 3, wherein a reverse check valve is mounted in the return line to prevent the fuel in the fuel tank from flowing into the fuel overflow prevention chamber when the fuel pump is driven in a forward direction.

5. The apparatus of claim 1, wherein a forward check valve is mounted in a discharge port of the fuel pump to prevent a fuel remaining in a feed line, mounted between the fuel pump and the engine, from flowing into the fuel tank when the fuel pump is driven in the reverse direction.

6. A method of preventing overflow of fuel from a fuel tank, comprising:

storing liquid fuel, leaking through a vent valve of the fuel tank while a vehicle travels, in a fuel overflow prevention chamber; and returning the fuel in the fuel overflow prevention chamber to the fuel tank by driving a fuel pump in a reverse direction for a predetermined time when an engine is stopped.

7. The method of claim 6, wherein the storing of liquid fuel includes separating the liquid fuel from fuel evaporation gas in a vent line connected between the vent valve and a canister.

8. The method of claim 6, wherein the storing of liquid fuel includes preventing the fuel in the fuel tank from flowing into the fuel overflow prevention chamber, when the fuel pump is driven in a forward direction, by closing a return line between the fuel overflow prevention chamber and the fuel pump using a reverse check valve mounted in the return line.

9. The method of claim 6, wherein the returning of the fuel in the fuel overflow prevention chamber to the fuel tank includes preventing a fuel remaining in a feed line, mounted between the fuel pump and the engine, from flowing into the fuel tank, when the fuel pump is driven in the reverse direction, by closing a discharge port of the fuel tank using a forward check valve mounted in the discharge port.

* * * * *